US008147749B2

(12) United States Patent
Reynolds

(10) Patent No.: US 8,147,749 B2
(45) Date of Patent: Apr. 3, 2012

(54) SUPERALLOY COMPOSITIONS, ARTICLES, AND METHODS OF MANUFACTURE

(75) Inventor: Paul L. Reynolds, Tolland, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 12/623,862

(22) Filed: Nov. 23, 2009

(65) Prior Publication Data

US 2010/0158695 A1 Jun. 24, 2010

Related U.S. Application Data

(63) Continuation of application No. 11/095,092, filed on Mar. 30, 2005, now abandoned.

(51) Int. Cl.
*C22C 19/05* (2006.01)

(52) U.S. Cl. ..... 420/448; 420/460; 419/10

(58) Field of Classification Search ..... 420/441–460; 419/10

See application file for complete search history.

(56) References Cited

U.S. PATENT DOCUMENTS

| | | | | |
|---|---|---|---|---|
| 3,061,426 | A | 10/1962 | Bieber | |
| 3,744,996 | A | 7/1973 | Shaw et al. | |
| 3,865,575 | A | 2/1975 | Volin et al. | |
| 3,869,284 | A | 3/1975 | Baldwin | |
| 3,890,816 | A | 6/1975 | Allen et al. | |
| 4,047,933 | A * | 9/1977 | Larson et al. | 75/255 |
| 4,061,495 | A | 12/1977 | Selman et al. | |
| RE29,920 | E * | 2/1979 | Baldwin | 420/445 |
| 4,209,348 | A | 6/1980 | Duhl et al. | |
| 4,261,742 | A | 4/1981 | Coupland et al. | |
| 4,569,824 | A | 2/1986 | Duhl et al. | |
| 4,719,080 | A | 1/1988 | Duhl et al. | |
| 4,814,023 | A | 3/1989 | Chang | |
| 4,878,953 | A | 11/1989 | Saltzman et al. | |
| 4,894,089 | A | 1/1990 | Henry | |
| 5,080,734 | A | 1/1992 | Krueger et al. | |
| 5,104,614 | A | 4/1992 | Ducrocq et al. | |
| 5,240,491 | A | 8/1993 | Budinger et al. | |
| 5,270,123 | A | 12/1993 | Walston et al. | |
| 5,399,313 | A | 3/1995 | Ross et al. | |
| 5,743,713 | A | 4/1998 | Hattori et al. | |
| 6,007,645 | A | 12/1999 | Cetel et al. | |
| 6,355,117 | B1 | 3/2002 | DeLuca et al. | |
| 6,444,057 | B1 | 9/2002 | Darolia et al. | |
| 6,521,053 | B1 * | 2/2003 | Grylls et al. | 148/280 |
| 6,521,175 | B1 | 2/2003 | Mourer et al. | |

(Continued)

FOREIGN PATENT DOCUMENTS

EP 1195446 A1 4/2002

(Continued)

OTHER PUBLICATIONS

ASM Handbook vol. 4: Heat Treating. Kiepura et al., ed. p. 810, 1991.

(Continued)

*Primary Examiner* — George Wyszomierski
*Assistant Examiner* — Tima M McGuthry Banks
(74) *Attorney, Agent, or Firm* — Bachman & LaPointe, P.C.

(57) ABSTRACT

A composition of matter comprises, in combination, in weight percent: a largest content of nickel; at least 16.0 percent cobalt; and at least 3.0 percent tantalum. The composition may be used in power metallurgical processes to form turbine engine turbine disks.

20 Claims, 5 Drawing Sheets

U.S. PATENT DOCUMENTS

| | | | |
|---|---|---|---|
| 6,673,308 | B2 | 1/2004 | Hino et al. |
| 6,706,241 | B1 | 3/2004 | Baumann et al. |
| 6,884,275 | B2 | 4/2005 | Okada et al. |
| 6,919,042 | B2 | 7/2005 | Beers et al. |
| 2002/0041821 | A1 | 4/2002 | Manning et al. |
| 2003/0041930 | A1 | 3/2003 | DeLuca et al. |
| 2004/0011443 | A1 | 1/2004 | Bouse et al. |
| 2004/0221927 | A1 | 11/2004 | Raymond et al. |
| 2006/0093849 | A1 | 5/2006 | Farmer et al. |

FOREIGN PATENT DOCUMENTS

| | | | |
|---|---|---|---|
| EP | 1201777 | A1 | 5/2002 |
| JP | 55-47351 | A | 4/1980 |
| JP | 64-4448 | A | 1/1989 |
| JP | 01-165741 | A | 6/1989 |
| JP | 2003-105458 | A | 4/2003 |
| JP | 2003-328061 | A | 11/2003 |
| RU | 2038401 | C1 | 6/1995 |

OTHER PUBLICATIONS

Measurement by Comparison Methods II from http://www.steeluniversity.org/content/html/eng/default.asp?catid-171 &pageid=20811271816. Copyright 2002-2007.

Japanese Office Action for JP2006-19930, dated Jun. 2, 2009.

European Search Report for EP06250464.2, dated Aug. 10, 2006.

Korean Office Action for KR Patent Application No. 10-2007-119568, dated Feb. 11, 2011.

* cited by examiner

TABLE I
Compositions (in Weight Percent Except as Noted)

| Element | Example Disk Alloy | | | | Prior Art | |
|---|---|---|---|---|---|---|
| | Exemplary Specification | | | Measured Sample Content | NF3 Nominal Content | ME16 Nominal Content |
| | Nominal Content | Nominal Minimum | Nominal Maximum | | | |
| Al | 3.14 | 3.0 | 3.5 | 3.19 | 3.6 | 3.4 |
| B | 0.03 | 0.02 | 0.06 | 0.053 | 0.03 | 0.025 |
| C | 0.03 | 0.02 | 0.07 | 0.047 | 0.03 | 0.05 |
| Co | 19.60 | 18.0 | 21.0 | 19.16 | 18.0 | 20.6 |
| Cr | 10.09 | 8.5 | 11.0 | 10.31 | 10.5 | 13.0 |
| Cu | | | 0.005 | <.005 | | |
| Fe | | | 0.1 | 0.02 | | |
| Hf | 0.40 | | 0.5 | 0.44 | | |
| Mn | | | 0.005 | 0.002 | | |
| Mo | 2.79 | 2.5 | 3.4 | 2.93 | 2.9 | 3.8 |
| Nb | 1.55 | 0.8 | 2.0 | 1.62 | 2.0 | 0.9 |
| S | | | 0.0005 | 0.0003 | | |
| Si | | | 0.1 | 0.06 | | |
| Ta | 7.28 | 6.5 | 8.5 | 7.20 | 2.5 | 2.4 |
| Ti | 2.17 | 2.0 | 2.75 | 2.25 | 3.6 | 3.7 |
| W | 2.62 | 2.2 | 2.75 | 2.68 | 3.0 | 2.1 |
| Zr | 0.05 | 0.03 | 0.07 | 0.057 | 0.05 | 0.05 |
| $O_2$ (ppm) | | | 150 | 108 | | |
| $N_2$ (ppm) | | | 100 | 10 | | |
| Ni | Bal | | | Bal | Bal | Bal |

FIG. 3

TABLE II
Physical Properties

| Property | Test Sample | Prior Art | | Percentage Improvement over Prior Art | |
|---|---|---|---|---|---|
| | | NF3 | ME16 | NF3 | ME16 |
| Time to Rupture (Hours) at 816°C (1500°F) and 448 MPa (65ksi) | 397 | 322 | 92 | 40% | 441% |
| Time to 0.5% Creep Deformation (Hours) at 816°C (1500°F) and 448 MPa (65ksi) | 82 | 57 | 15 | 43% | 444% |
| Ultimate Tensile Strength (MPa (ksi)) at 816°C (1500°F) | 1118.3 (162.2) | 1073.5 (155.7) | 1016.3 (147.4) | 4% | 10% |
| Yield Strength (MPa (ksi)) at 816°C (1500°F) | 897.7 (130.2) | 874.9 (126.9) | 807.4 (117.1) | 3% | 11% |
| Ultimate Tensile Strength (MPa (ksi)) at 732°C (1350°F) | 1351.3 (196.0) | 1285.9 (186.5) | 1286.6 (186.6) | 5% | 5% |
| Yield Strength (MPa (ksi)) at 732°C (1350°F) | 985.3 (142.9) | 994.9 (144.3) | 957.7 (138.9) | -1% | 3% |
| Relative Resistance to Quench Cracking (Resistance Factor) at 1093°C (2000°F) | 13.3 | 10.8 | 5.9 | 23% | 125% |

FIG. 6

SUPERALLOY COMPOSITIONS, ARTICLES, AND METHODS OF MANUFACTURE

CROSS-REFERENCE TO RELATED APPLICATION

This is a continuation application of Ser. No. 11/095,092, filed Mar. 30, 2005, now abandoned, and entitled Superalloy Compositions, Articles, and Methods of Manufacture, the disclosure of which is incorporated by reference herein in its entirety as if set forth at length.

U.S. GOVERNMENT RIGHTS

The invention was made with U.S. Government support under Agreement No. N00421-02-3-3111 awarded by the Naval Air Systems Command. The U.S. Government has certain rights in the invention.

BACKGROUND OF THE INVENTION

The invention relates to nickel-base superalloys. More particularly, the invention relates to such superalloys used in high-temperature gas turbine engine components such as turbine disks and compressor disks.

The combustion, turbine, and exhaust sections of gas turbine engines are subject to extreme heating as are latter portions of the compressor section. This heating imposes substantial material constraints on components of these sections. One area of particular importance involves blade-bearing turbine disks. The disks are subject to extreme mechanical stresses, in addition to the thermal stresses, for significant periods of time during engine operation.

Exotic materials have been developed to address the demands of turbine disk use. U.S. Pat. No. 6,521,175 discloses an advanced nickel-base superalloy for powder metallurgical manufacture of turbine disks. The disclosure of the '175 patent is incorporated by reference herein as if set forth at length. The '175 patent discloses disk alloys optimized for short-time engine cycles, with disk temperatures approaching temperatures of about 1500° F. (816° C.). Other disk alloys are disclosed in U.S. Pat. No. 5,104,614, US2004221927, EP1201777, and EP1195446.

Separately, other materials have been proposed to address the demands of turbine blade use. Blades are typically cast and some blades include complex internal features. U.S. Pat. Nos. 3,061,426, 4,209,348, 4,569,824, 4,719,080, 5,270,123, 6,355,117, and 6,706,241 disclose various blade alloys.

SUMMARY OF THE INVENTION

One aspect of the invention involves a nickel-base composition of matter having a relatively high concentration of tantalum coexisting with a relatively high concentration of one or more other components.

In various implementations, the alloy may be used to form turbine disks via powder metallurgical processes. The one or more other components may include cobalt. The one or more other components may include combinations of gamma prime (γ') formers and/or eta (η) formers.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

FIG. 3 is a table of compositions of an inventive disk alloy and of prior art alloys.

FIG. 6 is a table of select measured properties of the disk alloy and prior art alloys of FIG. 3.

Like reference numbers and designations in the various drawings indicate like elements.

DETAILED DESCRIPTION

Figure 1:
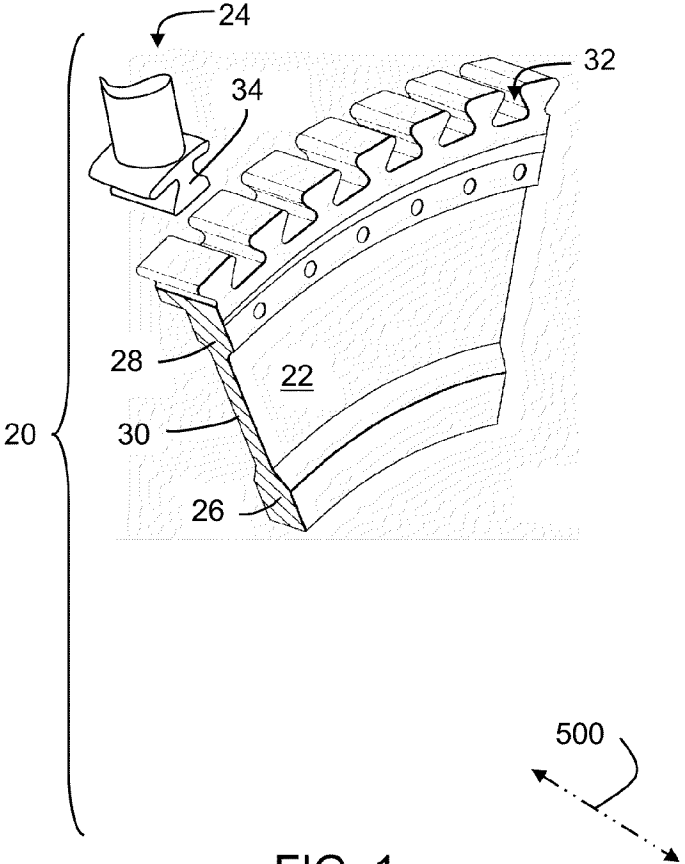
FIG. 1 is an exploded partial view of a gas turbine engine turbine disk assembly.

FIG. 1 shows a gas turbine engine disk assembly 20 including a disk 22 and a plurality of blades 24. The disk is generally annular, extending from an inboard bore or hub 26 at a central aperture to an outboard rim 28. A relatively thin web 30 is radially between the bore 26 and rim 28. The periphery of the rim 28 has a circumferential array of engagement features 32 (e.g., dovetail slots) for engaging complementary features 34 of the blades 24. In other embodiments, the disk and blades may be a unitary structure (e.g., so-called "integrally bladed" rotors or disks).

Figure 2:
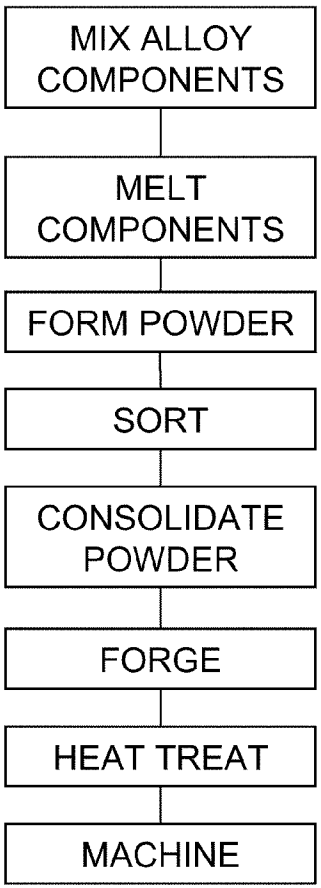
FIG. 2 is a flowchart of a process for preparing a disk of the assembly of FIG. 1.

The disk 22 is advantageously formed by a powder metallurgical forging process (e.g., as is disclosed in U.S. Pat. No. 6,521,175). FIG. 2 shows an exemplary process. The elemental components of the alloy are mixed (e.g., as individual components of refined purity or alloys thereof). The mixture is melted sufficiently to eliminate component segregation. The melted mixture is atomized to form droplets of molten metal. The atomized droplets are cooled to solidify into powder particles. The powder may be screened to restrict the ranges of powder particle sizes allowed. The powder is put into a container. The container of powder is consolidated in a multi-step process involving compression and heating. The resulting consolidated powder then has essentially the full density of the alloy without the chemical segregation typical of larger castings. A blank of the consolidated powder may be forged at appropriate temperatures and deformation constraints to provide a forging with the basic disk profile. The forging is then heat treated in a multi-step process involving high temperature heating followed by a rapid cooling process or quench. Preferably, the heat treatment increases the characteristic gamma (γ) grain size from an exemplary 10 μm or less to an exemplary 20-120 μm (with 30-60 μm being preferred). The quench for the heat treatment may also form strengthening precipitates (e.g., gamma prime (γ') and eta (η) phases discussed in further detail below) of a desired distribution of sizes and desired volume percentages. Subsequent heat treatments are used to modify these distributions to produce the requisite mechanical properties of the manufactured forging. The increased grain size is associated with good high-temperature creep-resistance and decreased rate of crack growth during the service of the manufactured forging. The heat treated forging is then subject to machining of the final profile and the slots.

Whereas typical modern disk alloy compositions contain 0-3 weight percent tantalum (Ta), the inventive alloys have a higher level. This level of Ta is believed unique among disk alloys. More specifically, levels above 3% Ta combined with relatively high levels of other γ' formers (namely, one or a combination of aluminum (Al), titanium (Ti), niobium (Nb), tungsten (W), and hafnium (Hf)) and relatively high levels of cobalt (Co) are believed unique. The Ta serves as a solid solution strengthening additive to the γ' and to the γ. The presence of the relatively large Ta atoms reduces diffusion principally in the γ' phase but also in the γ. This may reduce high-temperature creep. Discussed in further detail regarding the example below, a Ta level above 6% in the inventive alloys is also believed to aid in the formation of the η phase and insure that these are relatively small compared with the γ grains. Thus the η precipitate may help in precipitation hardening similar to the strengthening mechanisms obtained by the γ' precipitate phase.

It is also worth comparing the inventive alloys to the modern blade alloys. Relatively high Ta contents are common to modern blade alloys. There may be several compositional differences between the inventive alloys and modern blade alloys. The blade alloys are typically produced by casting techniques as their high-temperature capability is enhanced by the ability to form very large polycrystalline and/or single grains (also known as single crystals). Use of such blade alloys in powder metallurgical applications is compromised by the formation of very large grain size and their requirements for high-temperature heat treatment. The resulting cooling rate would cause significant quench cracking and tearing (particularly for larger parts). Among other differences, those blade alloys have a lower cobalt (Co) concentration than the exemplary inventive alloys. Broadly, relative to high-Ta modern blade alloys, the exemplary inventive alloys have been customized for utilization in disk manufacture through the adjustment of several other elements, including one or more of Al, Co, Cr, Hf, Mo, Nb, Ti, and W. Nevertheless, possible use of the inventive alloys for blades, vanes, and other non-disk components can't be excluded.

Accordingly, the possibility exists for optimizing a high-Ta disk alloy having improved high temperature properties (e.g., for use at temperatures of 1200-1500° F. (649-816° C.) or greater). It is noted that wherever both metric and English units are given the metric is a conversion from the English (e.g., an English measurement) and should not be regarded as indicating a false degree of precision.

EXAMPLE

Table I of FIG. 3 below shows a specification for one exemplary alloy or group of alloys. The nominal composition and nominal limits were derived based upon sensitivities to elemental changes (e.g., derived from phase diagrams). The table also shows a measured composition of a test sample. The table also shows nominal compositions of the prior art alloys NF3 and ME16 (discussed, e.g., in U.S. Pat. No. 6,521,175 and EP1195446, respectively). Except where noted, all contents are by weight and specifically in weight percent.

The most basic η form is $Ni_3$ Ti. It has generally been believed that, in modern disk and blade alloys, η forms when the Al to Ti weight ratio is less than or equal to one. In the exemplary alloy, this ratio is greater than one. From compositional analysis of the η phase, it appears that Ta significantly contributes to the formation of the η phase as $Ni_3$ (Ti, Ta). A different correlation (reflecting more than Al and Ti) may therefore be more appropriate. Utilizing standard partitioning coefficients one can estimate the total mole fraction (by way of atomic percentages) of the elements that substitute for atomic sites normally occupied by Al. These elements include Hf, Mo, Nb, Ta, Ti, V, W and, to a smaller extent, Cr. These elements act as solid solution strengtheners to the γ' phase. When the γ' phase has too many of these additional atoms, other phases are apt to form, such as η when there is too much Ti. It is therefore instructive to address the ratio of Al to the sum of these other elements as a predictive assessment for η formation. For example, it appears that η will form when the molar ratio of Al atoms to the sum of the other atoms that partition to the Al site in γ' is less than or equal to about 0.79-0.81. This is particularly significant in concert with the high levels of Ta. Nominally, for NF3 this ratio is 0.84 and the Al to Ti weight percent ratio is 1.0. For test samples of NF3 these were observed as 0.82 and 0.968, respectively. The η phase would be predicted in NF3 by the conventional wisdom Al to Ti ratio but has not been observed. ME16 has similar nominal values of 0.85 and 0.98, respectively, and also does not exhibit the η phase as would be predicted by the Al to Ti ratio.

The η formation and quality thereof are believed particularly sensitive to the Ti and Ta contents. If the above-identified ratio of Al to its substitutes is satisfied, there may be a further approximate predictor for the formation of η. It is estimated that η will form if the Al content is less than or equal to about 3.5%, the Ta content is greater than or equal to about 6.35%, the Co content is greater than or equal to about 16%, the Ti content is greater than or equal to about 2.25%, and, perhaps most significantly, the sum of Ti and Ta contents is greater than or equal to about 8.0%.

In addition to substituting for Ti as an η-former, the Ta has a particular effect on controlling the size of the η precipitates. A ratio of Ta to Ti contents of at least about three may be effective to control η precipitate size for advantageous mechanical properties.

Figure 4:
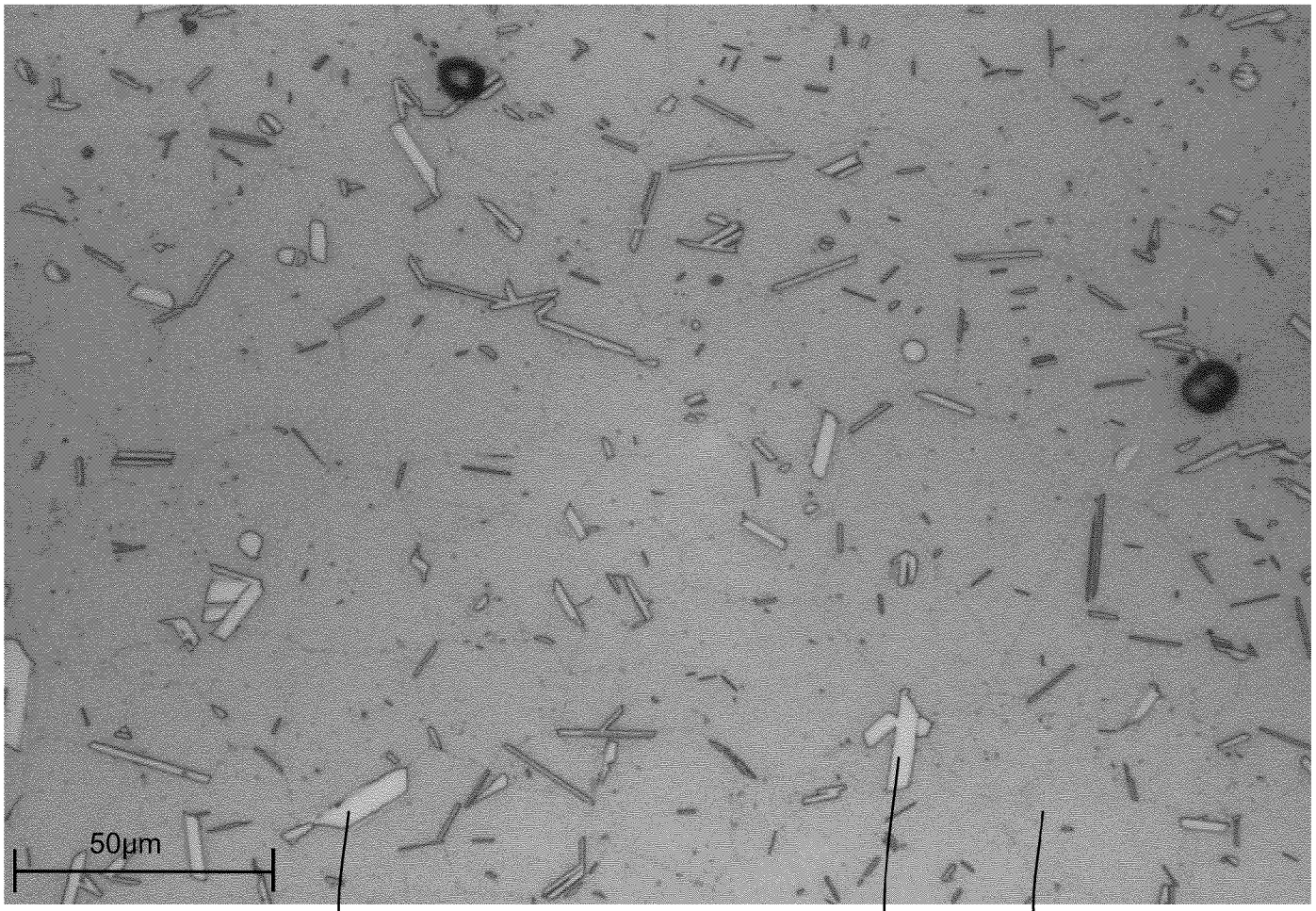
FIG. 4 is an etchant-aided optical micrograph of a disk alloy of FIG. 3.
Figure 5:
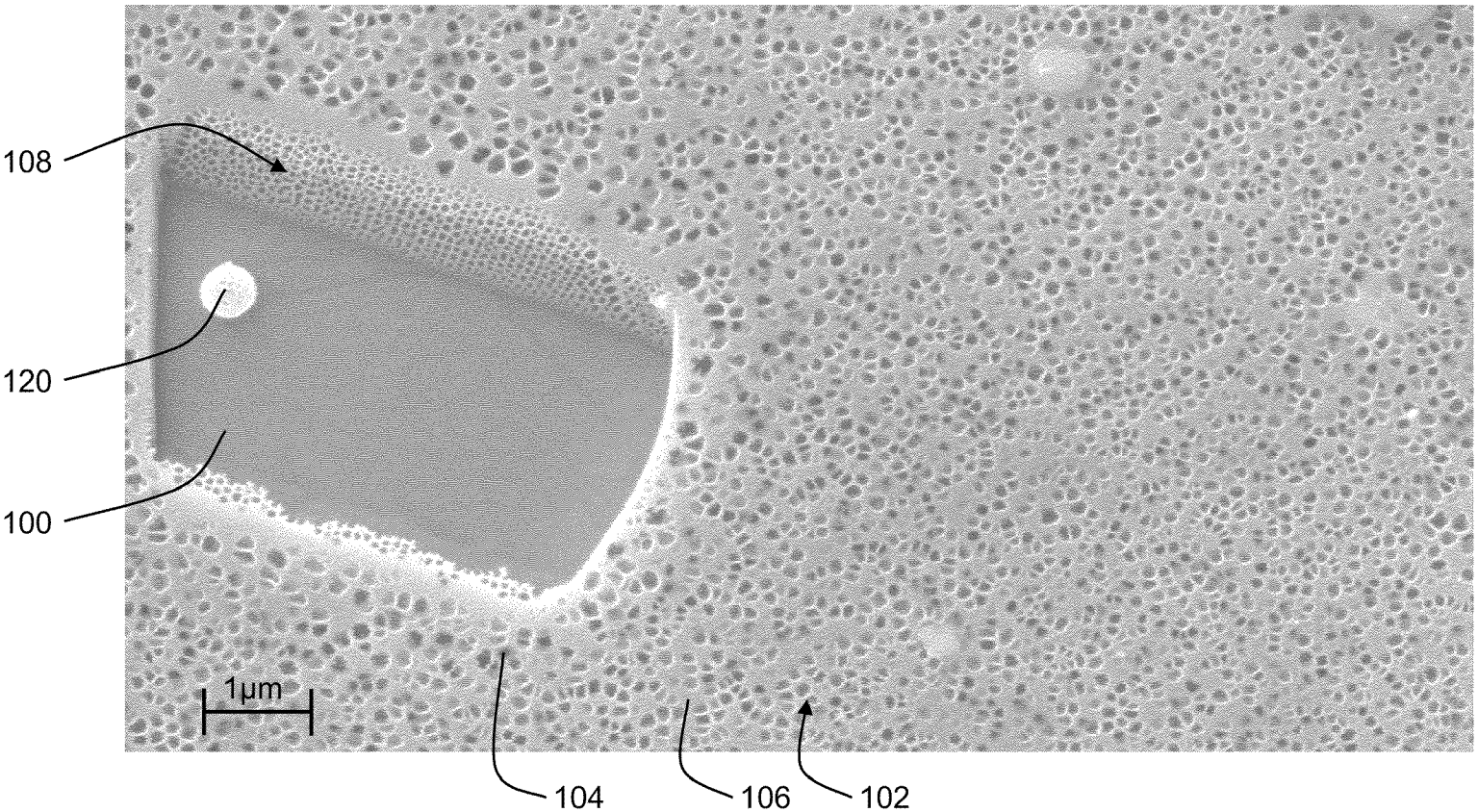
FIG. 5 is an etchant-aided scanning electron micrograph (SEM) of the disk alloy of FIG. 3.

FIGS. 4 and 5 show microstructure of the sample composition reflecting atomization to powder of about 74 μm (0.0029 inch) and smaller size, followed by compaction, forging, and heat treatment at 1182° C. (2160° F.) for two hours and a 0.93-1.39° C./s (56-83° C./minute (100-150° F./minute)) quench. FIG. 4 shows η precipitates 100 as appearing light colored within a γ matrix 102. An approximate grain size is 30 μm. FIG. 5 shows the matrix 102 as including much smaller γ' precipitates 104 in a γ matrix 106. These micrographs show a substantially uniform distribution of the η phase. The η phase is no larger than the γ grain size so that it may behave as a strengthening phase without the detrimental influence on cyclic behavior that would occur if the η phase were significantly larger.

FIG. 5 shows the uniformity of the γ' precipitates. These precipitates and their distribution contribute to precipitation strengthening. Control of precipitate size (coarsening) and spacing may be used to control the degree and character of precipitate strengthening. Additionally, along the η interface is a highly ordered/aligned region 108 of smaller γ' precipitates. These regions 108 may provide further impediments to dislocation motion. The impediment is a substantial component of strengthening against time-dependent deformation, such as creep. The uniformity of the distribution and very fine size of the γ' in the region 108 indicates this is formed well below the momentary temperatures found during quenching.

Alloys with a high γ' content have been generally regarded as difficult to weld. This difficulty is due to the sudden cooling from the welding (temporary melting) of the alloy. The sudden cooling in high γ' alloys causes large internal stresses to build up in the alloy leading to cracking.

The one particular η precipitate enlarged in FIG. 5 has an included carbide precipitate 120. The carbide is believed primarily a titanium and/or tantalum carbide which is formed during the solidification of the powder particles and is a natural by-product of the presence of carbon. The carbon, however, serves to strengthen grain boundaries and avoid brittleness. Such carbide particles are extremely low in volume fraction, extremely stable because of their high melting points and believed not to substantially affect properties of the alloy.

As noted above, it is possible that additional strengthening is provided by the presence of the η phase at a size that is small enough to contribute to precipitate phase strengthening while not large enough to be detrimental. If the η phase were to extend across two (or more) grains, then the dislocations from deformation of both grains would be more than additive and therefore significantly detrimental, (particularly in a cyclic environment). Exemplary η precipitates are approximately 2-14 μm long in a field of 0.2 μm cooling γ' and an average grain diameter (for the γ) of 30-45 μm. This size is approximately the size of large γ' precipitates as found in conventional powder metallurgy alloys such as IN100 and ME16. Testing to date has indicated no detrimental results (e.g., no loss of notch ductility and rupture life).

Table II of FIG. 6 shows select mechanical properties of the exemplary alloy and prior art alloys. All three alloys were heat treated to a grain size of nominal ASTM 6.5 (a diameter of about 37.8 μm (0.0015 inch)). All data were taken from similarly processed subscale material (i.e., heat treated above the γ' solvus to produce the same grain size and cooled at the same rate). The data show a most notable improvement in quench crack resistance for the inventive alloys. It is believed that the very fine distribution of γ' in the region 108 around the η precipitate (which γ' precipitates do not form until very low temperatures are reached during the quench cycle) are participating in the improved resistance to quench cracking. A lack of this γ' around the η might encourage the redistribution of the stresses during the quench cycle to ultimately cause cracking.

From Table II it can be seen that, for equivalent grain sizes, the sample composition has significant improvements at 816° C. (1500° F.) in time dependent (creep and rupture) capability and yield and ultimate tensile strengths. At 732° C. (1350° F.) the sample composition has slightly lower yield strength than NF3 but still significantly better than ME16. Further gains in these properties might be achieved with further composition and processing refinements.

A test has been devised to estimate relative resistance to quench cracking and results at 1093° C. (2000° F.) are also given in Table II. This test accounts for an ability to withstand both the stresses and strains (deformation) expected with a quench cycle. The test is dependent only on the grain size and the composition of the alloy and is independent of cooling rate and any subsequent processing schedule. The sample composition showed remarkable improvements over the two baseline compositions at 1093° C. (2000° F.)

Alternative alloys with lower Ta contents and/or a lack of η precipitates may still have some advantageous high temperature properties. For example, lower Ta contents in the 3-6% range or, more narrowly the 4-6% range are possible. For substantially η-free alloys, the sum of Ti and Ta contents would be approximately 5-9%. Other contents could be similar to those of the exemplary specification (thus likely having a slightly higher Ni content). As with the higher Ta alloys, such alloys may also be distinguished by high Co and high combined Co and Cr contents. Exemplary combined Co and Cr contents are at least 26.0% for the lower Ta alloys and may be similar or broader (e.g., 20.0% or 22.0%) for the higher Ta alloys.

One or more embodiments of the present invention have been described. Nevertheless, it will be understood that various modifications may be made without departing from the spirit and scope of the invention. For example, the operational requirements of any particular engine will influence the manufacture of its components. As noted above, the principles may be applied to the manufacture of other components such as impellers, shaft members (e.g., shaft hub structures), and the like. Accordingly, other embodiments are within the scope of the following claims.

What is claimed is:

1. A composition of matter, comprising in combination, in weight percent:
a content of nickel as a largest content;
at least 16.0 percent cobalt;
at least 6.0 percent tantalum;
3.0-3.5 percent aluminum;
8.5-11.0 percent chromium;
2.5-3.4 percent molybdenum;
0.8-2.0 percent niobium;
at least 1.5 percent titanium; and
at least 0.02 percent boron.

2. The composition of claim 1 wherein:
said content of nickel is at least 50 percent.

3. The composition of claim 1 wherein:
said content of nickel is 44-56 percent.

4. The composition of claim 1 wherein:
said content of nickel is 48-52 percent.

5. The composition of claim 1 wherein:
a ratio of said titanium content to said aluminum content is at least 0.57.

6. The composition of claim 1 wherein:
a combined content of said tantalum, aluminum, titanium, and niobium is at least 12.3 percent.

7. The composition of claim 1 further comprising:
no more than 4.0 percent, individually, of every additional constituent, if any.

8. The composition of claim 1 further comprising:
at least 5.8% combined of one or more of said aluminum, said titanium, said niobium, and hafnium.

9. The composition of claim 1 further comprising:
at least 6.5% combined of said aluminum, said titanium, said niobium, and hafnium.

10. The composition of claim 1 further comprising:
at least 1.5 percent tungsten.

11. The composition of claim 1 in powder form.

12. The composition of claim 1 further comprising, by weight:
2.0-2.75 percent said titanium;
2.2-2.75 percent tungsten; and
0.03-0.07 percent zirconium.

13. The composition of claim 1 further comprising, by weight up to:
0.005 percent copper;
0.1 percent iron;
0.5 percent hafnium;
0.005 percent manganese; and
0.1 percent silicon.

14. A process for forming an article comprising:
compacting a powder having the composition of claim 1;
forging a precursor formed from the compacted powder; and
machining the forged precursor.

15. The process of claim 14 further comprising:
heat treating the precursor, at least one of before and after the machining, by heating to a temperature of no more than 1232° C. (2250° F.).

16. The process of claim 14 further comprising:
heat treating the precursor, at least one of before and after the machining, the heat treating effective to increase a characteristic γ grain size from a first value of about 10 μm or less to a second value of 20-120 μm.

17. A gas turbine engine turbine or compressor disk having the composition of claim 1.

18. A powder metallurgical gas turbine engine disk or disk substrate comprising in combination, in weight percent:

from about 18.0 percent to about 21.0 percent cobalt, from about 8.5 percent to about 11.0 percent chromium, from about 6.5 percent to about 8.5 percent tantalum, from about 2.2 percent to about 2.75 percent tungsten, from about 2.5 percent to about 3.4 percent molybdenum, from about 0.03 percent to about 0.07 percent zirconium, from about 0.8 percent to about 2.0 percent niobium, from about 2.0 percent to about 2.75 percent titanium, from about 3.0 percent to about 3.5 percent aluminum, from about 0.02 percent to about 0.07 percent carbon, from about 0.02 percent to about 0.06 percent boron; and balance nickel and minor amounts of impurities.

19. A powder metallurgical gas turbine engine disk or disk substrate comprising in combination, in weight percent:

a content of nickel as a largest content;

at least 16.0 percent cobalt;

at least 26.0 percent combined cobalt and chromium;

at least 3.0 percent tantalum;

at least 0.5 percent niobium;

at least 3.0 percent aluminum; and a titanium content, a ratio of said titanium content to said aluminum content being at least 0.57.

20. A powder metallurgical gas turbine engine disk or disk substrate comprising in combination, in weight percent:

from 18.0 percent to 21.0 percent cobalt, from 8.5 percent to 11.0 percent chromium, from 6.5 percent to 8.5 percent tantalum, from 2.2 percent to 2.75 percent tungsten, from 2.5 percent to 3.4 percent molybdenum, from 0.03 percent to 0.07 percent zirconium, from 0.8 percent to 2.0 percent niobium, from 2.0 percent to 2.75 percent titanium, from 3.0 percent to 3.5 percent aluminum, from 0.02 percent to 0.07 percent carbon, from 0.02 percent to 0.06 percent boron; and nickel as a largest content.

* * * * *